US007146900B1

(12) United States Patent
Matsumoto et al.

(10) Patent No.: US 7,146,900 B1
(45) Date of Patent: Dec. 12, 2006

(54) COMPOSITE OPERATION TYPE ACTUATOR

(75) Inventors: Kazuki Matsumoto, Tokyo (JP); Kazushi Nomura, Tokyo (JP); Ryuzo Yagishita, Tokyo (JP)

(73) Assignee: Nambu Co., Ltd., Tokyo (JP)

( * ) Notice: Subject to any disclaimer, the term of this patent is extended or adjusted under 35 U.S.C. 154(b) by 4 days.

(21) Appl. No.: 11/143,713

(22) Filed: Jun. 3, 2005

(51) Int. Cl.
*F15B 15/04* (2006.01)

(52) U.S. Cl. ..... 91/170 R; 92/65

(58) Field of Classification Search ..... 91/170 R, 91/177, 178; 92/65, 67; 74/20, 21
See application file for complete search history.

(56) References Cited

U.S. PATENT DOCUMENTS

| | | | | |
|---|---|---|---|---|
| 4,036,309 | A * | 7/1977 | Petreev et al. | 92/65 |
| 4,208,879 | A * | 6/1980 | Segawa | 60/547.1 |
| 4,216,700 | A * | 8/1980 | Iida | 91/170 R |
| 5,806,404 | A * | 9/1998 | Sher | 92/31 |

FOREIGN PATENT DOCUMENTS

| | | | |
|---|---|---|---|
| JP | 46-33457 | | 9/1971 |
| JP | 63-29921 | | 8/1988 |
| JP | 1-118203 | | 8/1989 |
| JP | 2-14803 | * | 1/1990 |
| JP | 2875220 B2 | | 1/1999 |

* cited by examiner

*Primary Examiner*—Thomas E. Lazo
(74) *Attorney, Agent, or Firm*—Sughrue Mion, PLLC

(57) ABSTRACT

A cylinder chamber 17 at the front of a direct-acting type actuator section 10 is connected to a cylinder chamber 37 at the front of an oscillating type actuator section 30 through a sequence valve with check valve 40. Further, a cylinder chamber 18 in the rear of the direct-acting type actuator section 10 is connected to a cylinder chamber 38 in the rear of the oscillating type actuator 30 through a stop valve 50. Ports 61 and 62 are provided for connecting passages between the cylinder chamber 37 and the sequence valve with check valve 40 and between the cylinder chamber 18 and the stop valve 50, respectively, for distribution control of a working fluid. According to the setting conditions of the respective valves 40 and 50, the piston rod 11 can perform an ordinary reciprocating motion and a motion that combines rotation and advancement.

2 Claims, 9 Drawing Sheets

*Fig.1*

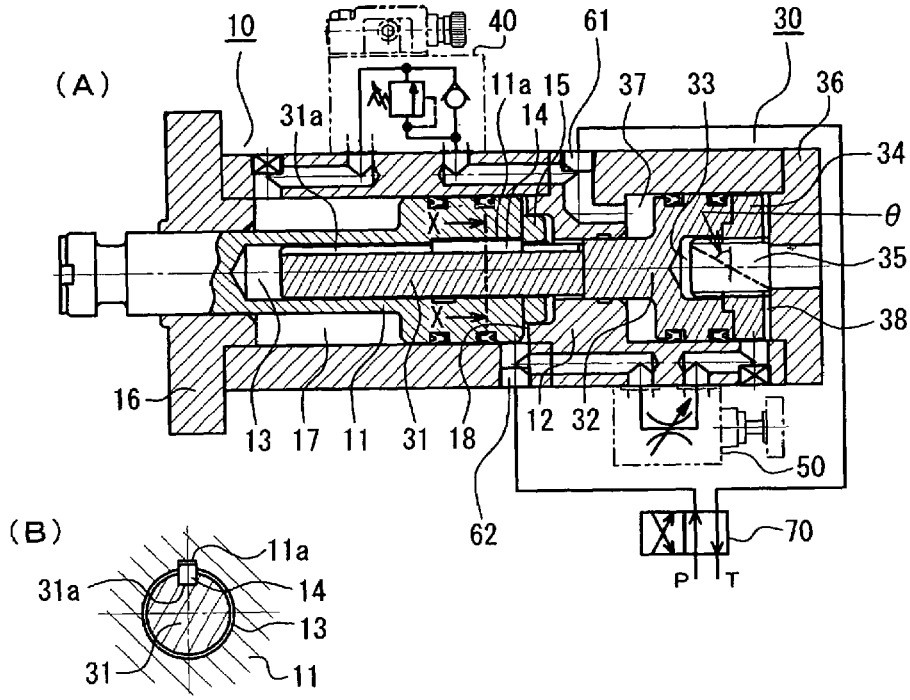

*Fig.2*

| | sequence valve with check valve 40 | stop valve 50 | motion of piston rod 11 |
|---|---|---|---|
| A1 | open | closed | advancement ⟵ / ⟶ retraction |
| B1 | open | open | advancement → advancement with rotation → retraction → retraction with rotation → advancement |
| C1 | switches from closed to open at predetermined pilot-pressure or higher | open | advancement → advancement with rotation → retraction → rotation only → advancement |

| | sequence valve with check valve 40 | stop valve 50 | motion of piston rod 11 |
|---|---|---|---|
| A2 | open | closed | advancement ⟵ / ⟶ retraction |
| B2 | open | open | advancement; retraction with rotation; advancement with rotation; retraction |
| C2 | switches from closed to open at predetermined pilot pressure or higher | open | advancement; retraction with rotation; rotation only; retraction |

COMPOSITE OPERATION TYPE ACTUATOR

BACKGROUND OF THE INVENTION

1. Field of the Invention

The present invention relates to a field of a fluid pressure actuator, and more specifically relates to an improved technique about a composite operation type actuator for causing a rod to perform a motion that combines a reciprocating motion with an oscillating motion. In particular, in the composite operation type actuator of the present invention, a direct-acting type actuator section and an oscillating type actuator section are coupled in series to perform a composite operation. Then, with a simple configuration in which a sequence valve with check valve and a throttle valve (or a stop valve) are respectively interposed in passages connecting respective cylinder chambers of the actuator sections, the composite operation is rationally performed just by working fluid distribution switching control over two ports.

2. Description of the Related Art

For setting and extracting core pins for die-casting molds, fluid pressure actuators have been traditionally used.

In this case, extraction of the core pin is performed in a state where molten metal is cooled in a cavity and solidified or semi-solidified. Since the molten metal is cooled and contracted for solidification, scuffing or seizure tends to occur between the core pin and a product.

Accordingly, it has become common practice to apply a draft angle to the core pin so as to facilitate detachment of the core pin, thereby preventing generation of a defective product.

However, a drill formed for the core pin with the draft angle is scarcely used without alteration. Thus, an additional work for modifying the drill to a straight one is applied after molding has been performed. This has therefore become a factor for leading to an increase in the cost of the product.

On the other hand, a lot of fluid pressure actuators for causing a piston rod to perform a motion that combines an oscillating motion with a reciprocating motion have been proposed for a long time. If the actuator of this type is used, it becomes possible to extract the core pin while being rotated or after having been rotated.

More specifically, just by extracting the core pin in the axial direction of the actuator, the product tends to be defective due to scuffing or seizure. However, if extraction of the core pin with rotation is performed, the core pin can be extracted comparatively easily without laboring. Especially in a state where the molten metal is semi-solidified under a certain condition, it sometimes becomes possible to form a drill with an extremely high precision even if the draft angle is not applied to the core pin.

Then, among the actuators that have implemented the motion that combines the oscillating motion with the reciprocating motion are the actuators disclosed in a. Japanese Patent Examined Publication SH046-33457, b. Japanese Utility Model Examined Publication SH063-29921, c. Japanese Utility Model Unexamined Publication HEI01-118203, d. Japanese Utility Model Unexamined Publication HEI02-14803, and e. Japanese Patent Publication No.2875220, for example.

In the publications a. to c., the composite operation type actuator using either of the following methods is proposed: A pinion is directly mounted to the piston rod of a direct-acting type actuator for the reciprocating motion so that it forms the constrained pair of only a sliding pair with the piston rod of the direct-acting type actuator, or the pinion is fixed to a shaft rod fitted inside a hollow opening formed from the rear surface of the piston rod in the axial direction so that the axial rod forms only the sliding pair with the hollow opening. Then, a rack to be meshed with the pinion is moved by another direct-acting type actuator for the oscillating motion.

On the other hand, the publication d. discloses the composite operation type actuator shown in FIG. 18(A).

This actuator is constituted from a direct-acting type actuator section 100 and an oscillating type actuator section 120 of a cylinder structure. The oscillating type actuator section 120 is coupled in series to a head cover 102 of the direct-acting type actuator 100 so that an oscillating shaft 121 of the oscillating type actuator section 120 is arranged on the same axis as a piston rod 101 of the direct-acting type actuator section 100.

The direct-acting type actuator section 100 constitutes a structure of a single rod double-acting cylinder, and in a piston rod 101 thereof, a hollow opening 103 is formed from a rear surface of the piston rod in the axial direction.

The oscillating type actuator section 120 also has a cylinder structure, in which the oscillating shaft 121 is rotatably supported by radial bearings 124 and 125 provided for covers 122 and 123 at the front and the back of the oscillating type actuator section 120, respectively.

On the oscillating shaft 121, a ball screw 127 is formed in a section within a cylinder tube 126, and an opening for causing the oscillating shaft 121 to pass through a piston 128 is formed in the piston 128. This opening constitutes a screw opening 129, and balls (not shown) are interposed between the ball screw 127 on the side of the oscillating shaft 121 and the screw opening 129 on the side of the piston 128.

Further, a protrusion 130 is formed on the outer periphery side of the piston 128, and this protrusion 130 is loosely fitted into a guide opening 131 in the axial direction formed in the cylinder tube 126.

The front section of the oscillating shaft 121 is inserted inside the hollow opening 103 of the piston rod 101, after penetrating the head cover 102 of the direct-acting type actuator section 100.

Then, in the section where the oscillating shaft 121 is inserted inside the hollow opening 103, sections 121*a* at opposed locations of the outer peripheral surface of the oscillating shaft 121 are formed in a planar form. Then, as shown in FIG. 18(B), a bush 104 secured to the rear end of the hollow opening 103 of the piston rod 101 causes the front section of the oscillating shaft 121 to be inserted inside the hollow opening 103 to form the constrained pair of only a sliding pair with the hollow opening 103 of the piston rod 101.

Incidentally, a section in the hollow opening 103 of the piston rod 101, in front of the leading edge of the oscillating shaft 121, should be linked to the cylinder chamber on the side of the head cover of the direct-acting type actuator section 100. The publication d., however, does not give a description about this configuration.

As shown in FIG. 18(A), the direct-acting type actuator section 100 and the oscillating type actuator section 120 of this composite operation type actuator are separately controlled by four-port three-position switching valves 141 and 142, respectively.

More specifically, according to this composite operation type actuator, distribution control of a working fluid over distribution ports 105 and 106 using the four-port three position switching valve 141 enables the piston rod 101 to reciprocate. Further, distribution control of the working fluid over distribution ports 132 and 133 using the four-port three-position switching valve 142 enables the piston 128 to be moved to and fro, thereby enabling rotation of the oscillating shaft 121. Since these controls can be independently executed at arbitrary timings, the motion of the piston rod 101 that combines the reciprocating motion with the oscillating motion can be freely performed.

One of the inventors of the present invention is the co-inventor of the above-mentioned publication e. The publication e. discloses a cylinder device suitable for setting and extracting the core pin. The cylinder device implements the operation of rotating the piston rod during a final certain period of the thrusting step of the core pin and an initial certain period of the drawing-in step of the core pin alone. For the period other than these periods, the rod is not rotated.

According to the composite operation type actuator in the above-mentioned publication d., the above-mentioned motion of the piston rod 10 that combines the reciprocating motion and the oscillating motion can be executed at an arbitrary timing.

However, in order to individually control the direct-acting type actuator section 100 and the oscillating type actuating section 120, the two four-port three-position switching valves 141 and 142 are necessary, and the cost of an overall system including a peripheral fluid circuit and a sequence control system becomes rather high.

Further, the composite operation type actuator described above requires four tubing. When a lot of the actuators for actuating the core pin are integrated into the die-casting mold, the number of tubing for the mold becomes extremely great, so that tube arrangement becomes complicated. At the same time, when a space for installing the actuators cannot be sufficiently secured, design of the die-casting mold becomes difficult.

On the other hand, in the case of the actuator for operating the core pin, it is enough that the operation of retracting the piston rod while being rotated from a forward limit position or the operation of retracting the piston rod after having being rotated can be performed, and the operation that combines the reciprocating motion with oscillating motion in a complicated sequence is not required.

SUMMARY OF THE INVENTION

The present invention has been made in view of the problems described above. It is therefore an object of the present invention to provide a composite operation type actuator in which the motion of a piston rod required for the actuator for operating a core pin is executed by distribution control over two ports therein, thereby simplifying a peripheral fluid circuit and a sequence control system and reducing the cost of an overall system including the peripheral fluid circuit and the sequence control system. The composite operation type actuator of the present invention described above is implemented just by making a simple improvement on a conventional composite operation type actuator constituted from a direct-acting type actuator section and an oscillating type actuator section as disclosed in the above-mentioned publication d. Especially when a lot of actuators for operating the core pin are integrated into a die-casting mold, it sometimes happens that a space for installing the actuators cannot be sufficiently secured. The present invention, however, reduces the number of piping, thereby providing an actuator that is effective for being applied under such a condition.

Further, the present invention provides a highly versatile actuator which is the composite operation type actuator but can also be used as an ordinary double-acting actuator by performing setting of attached valves under a certain condition.

The present invention is constituted from a first invention and a second invention, both of which are based on the composite operation type actuator having the configuration which will be described below.

The first and second inventions are based on the composite operation type actuator constituted from a direct-acting type actuator section and an oscillating type actuator section of a cylinder structure. The oscillating type actuator section is coupled to the head cover of the direct-acting type actuator section so that the piston rod of the direct-acting actuator section is disposed on the same axis as the oscillating shaft of the oscillating type actuator section. The oscillating shaft passes through the head cover and is fitted into a hollow opening formed from the rear surface side of the piston rod of the direct-acting type actuator section in the axial direction of the composite operation type actuator. Further, the oscillating shaft and the hollow opening are combined to form the constrained pair of a sliding pair in the axial direction. Reciprocating and oscillating motions of the piston rod of the direct-acting type actuator section are thereby enabled.

In the composite operation type actuator according to first invention, the cylinder chamber on the side of the rod cover of the direct-acting type actuator section is connected to one of the cylinder chambers of the oscillating type actuator section, hereinafter referred to as a "first cylinder section" through a sequence valve with check valve. The cylinder chamber on the side of the head cover of the direct-acting type actuator section is connected to the other of the cylinder chambers of the oscillating type actuator section, hereinafter referred to as a "second cylinder" through a stop valve or a throttle valve. Distribution ports are provided for the connecting passage between the first cylinder chamber of the oscillating type actuator section and the sequence valve with check valve and the connecting passage between the cylinder chamber on the side of the head cover of the direct-acting type actuator section and the stop valve or the throttle valve, respectively. Incidentally, in the present invention, the distribution port for the former connecting passage will be hereinafter referred to as a "first port", while the distribution port for the connecting passage for the latter connecting passage will be hereinafter referred to as a "second port".

Then, according to the present invention, the motion of the piston rod of the direct-acting type actuator section can be adjusted and set according to the setting condition of the pilot pressure of the sequence valve with check valve and the open-state or closed-state setting condition of the stop valve or the throttle valve.

According to the setting conditions of the sequence valve with check valve and the stop valve or the throttle valve, the composite operation type actuator of the present invention enters the following three operating modes:

(1) When the sequence valve with check valve is set to be open and the stop valve or the throttle valve is set to be closed, the oscillating type actuator section will not be actuated because the stop valve or the throttle valve is set to be closed. Since the sequence valve with check valve is set to be open, the direct-acting type actuator section will operate as an ordinary dual-acting cylinder.

(2) When the sequence valve with check valve and the stop valve or the throttle valve are both set to be open, the cylinder chamber on the side of the rod cover of the direct-acting actuator section is always linked to the first cylinder chamber of the oscillating type actuator section.

Further, the cylinder chamber on the side of the head cover of the direct-acting actuator section is always linked to the second cylinder chamber of the oscillating type actuator section. Accordingly, both of the direct-acting actuator section and the oscillating type actuator section are in one of their movable limits. When a working fluid is supplied from one of the distribution ports, and the other of the distribution ports is drained to start the operation of the composite operation type actuator, both of the actuator sections operate for an initial period. Then, when one of the actuator sections has reached its movable limit and then has stopped in the course of the operation, only the other of the actuator sections will continuously operate to its movable limit. When the operation of the oscillating type actuator section has been first completed and is stopped, the piston rod of the direct-acting type actuator section rotates while moving straight ahead for an initial certain period. Then, when the period is completed, the piston rod moves straight ahead only, and moves to its movable limit.

(3) When the pressure of the sequence valve with check valve at the time of switching of the sequence valve with check valve from a closed state to an open state is adjusted to be a predetermined level, and when the stop valve or the throttle valve is set to be open, the operation of the composite operation type actuator differs depending on whether an advancement step of the piston rod is executed or a retraction step of the piston rod is executed. When the direct-acting actuator section and the oscillating type actuator section are both in the states of their backward limits, when the working fluid is supplied from the second port, and when the operations of the actuator sections are started with the first port being drained, the operation of the composite operation type actuator will be the same as in the case of the operating mode (1) described above. In this case, the working fluid in the first cylinder chamber of the direct-acting type actuator is drained from the first port through the check valve of the sequence valve with check valve.

On the other hand, when the operation of the composite-type actuator is started in the state where the direct-acting type actuator section and the oscillating type actuator section are both in the states of their forward limits, when the working fluid is supplied from the first port, and when the second port is drained, the oscillating type actuator section immediately operates. However, since the pressure of the sequence valve with check valve is set, the sequence valve with check valve is kept closed until the pressure of the sequence valve with check valve becomes the set value. Accordingly, the piston rod of the direct-acting type actuator section only rotates until the operation of the oscillating type actuator is completed. Then, when the operation of the oscillating type actuator has been completed, the pressure at the first port increases to a predetermined level or higher. Thus, the sequence valve with check valve is switched from the closed state to the open state. Thereafter, the piston rod of the direct-acting type actuator section thereby starts retracting.

In the composite operation type actuator in the second invention, the cylinder chamber on the side of the rod cover of the direct-acting type actuator section is connected to the first cylinder chamber of the oscillating type actuator through the stop valve or the throttle valve. The cylinder chamber on the side of the head cover of the direct-acting type actuator section is connected to the second cylinder chamber of the oscillating type actuator section through the sequence valve with check valve. Then, the distribution ports are provided for the connecting passage between the first cylinder chamber of the direct-acting type actuator section and the stop valve or the throttle valve and the connecting passage between the second cylinder chamber of the oscillating type actuator section and the sequence valve with check valve, respectively. In the present invention, the distribution port for the former connecting passage will be hereinafter referred to as a "first port", while the distribution port for the latter connecting passage will be hereinafter referred to as a "second port".

Then, in this invention as well, as in the first invention, the motion of the piston rod of the direct-acting type actuator section can be set and adjusted according to the setting condition of the pilot pressure of the sequence valve with check valve and the open-state or closed-state setting condition of the stop valve or the throttle valve.

As compared with the first invention, the structures of the direct-acting type actuator section and the oscillating actuator section in this invention are the same. However, the mounting positions of the sequence valve with check valve and the stop valve or the throttle valve are reversed from the case of the first invention, and the positions of the first port and the second port for the connecting passages between the respective valves and the respective cylinder chambers are different.

As in the first invention, the composite operation type actuator in this invention also enters the three operating modes according to the setting conditions of the sequence valve with check valve and the stop valve or the throttle valve. However, the configuration of a fluid circuit eventually becomes identical, so that the setting conditions of the respective valves and the operation of the actuator in the operating modes (1) and (2) described above become the same.

This invention is different from the first invention in the case when the pressure of the sequence valve with check valve when the sequence valve with check valve is switched from the closed to the open state is adjusted to be a predetermined level and the stop valve or the throttle valve is open, as in the operating mode (3). In this case, the direct-acting type actuator section and the oscillating type actuator section are both in their backward limits, the working fluid is supplied to the second port, and the first port is drained.

In this case, the oscillating type actuator section immediately actuated. However, since the pressure of the sequence valve with check valve is set, the sequence valve with check valve is kept closed until the pressure of the sequence valve with check valve becomes the set value. Accordingly, the piston rod of the direct-acting type actuator section only rotates until the operation of the oscillating type actuator is completed. Then, when the operation of the oscillating type actuator is completed, the pressure at the first port increases to a predetermined level or higher. Thus, the sequence valve with check valve is switched from the closed state to the open state. The piston rod of the direct-acting type actuator section will thereby start the advancing motion thereafter.

More specifically, in the first invention, when the piston rod retracts from its forward limit, the sequence in which the rotating motion and the advancement motion are performed independently is executed. In the second invention, this sequence is executed when the piston rod advances from its backward limit.

The various features of novelty which characterize the invention are pointed out with particularity in the claims annexed to and forming a part of this specification. For a better understanding of the invention, its operating advantages, and specific objects attained by its use, reference should be had to the accompanying drawing and descriptive matter in which there is illustrated and described a preferred embodiment of the invention.

BRIEF DESCRIPTION OF THE DRAWINGS

FIG. 1(A) is a diagram showing a section of a composite operation type actuator and a configuration of an attached fluid circuit according to a first embodiment of the present invention;

FIG. 1(B) is an auxiliary view showing a section taken in the direction of arrows X in FIG. 1(A);

FIG. 2 is an operating mode table showing the relationship between setting conditions of a sequence valve with check valve and a stop valve and a motion of a piston rod in the composite operation type actuator in the first embodiment;

DETAILED DESCRIPTION OF THE PREFERRED EMBODIMENTS

Figure 3:
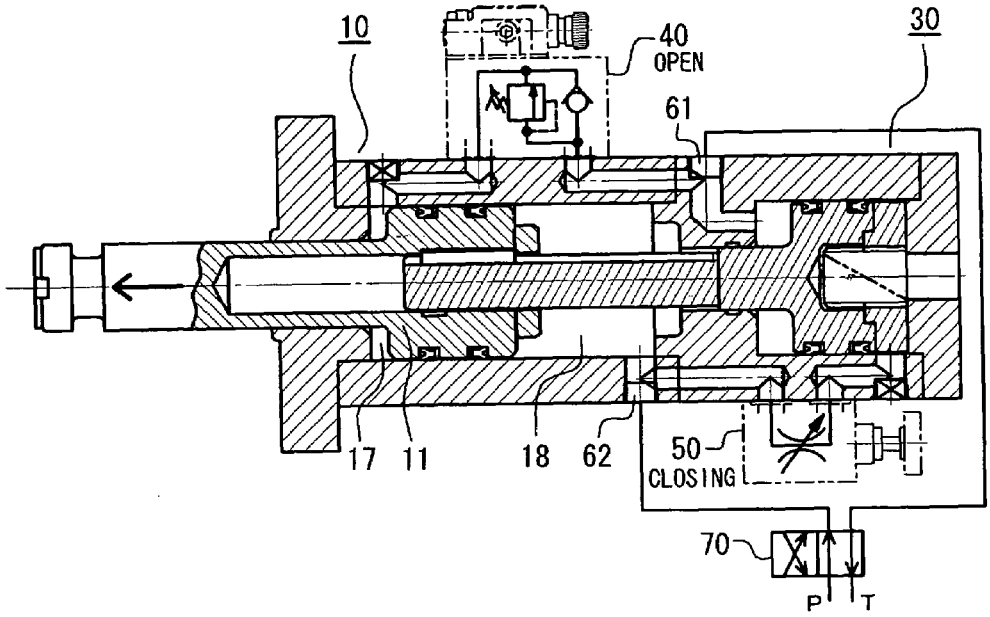
FIG. 3 is a diagram showing a section of the composite operation type actuator in the course of an operation in an A1 mode and the configuration of the attached fluid circuit, in the first embodiment.

Embodiments of a composite operation type actuator according to the present invention will be described below in detail with reference to the drawings.

First Embodiment

A sectional view of a composite operation type actuator and a configuration of an attached fluid circuit according to a first embodiment of the present invention are shown in FIG. 1(A).

Referring to FIG. 1(A), the composite operation type actuator is constituted from a direct-acting type actuator section 10 and an oscillating type actuator section 30. The oscillating type actuator section 30 is coupled to a head cover 12 of the direct-acting type actuator section 10 so that an oscillating shaft 31 thereof is arranged on the same axis as a piston rod 11 of the direct-acting type actuator section 10.

Each of the direct-acting type actuator section 10 and the oscillating type actuator section 30 constitutes a double-acting cylinder structure of a single rod type.

A hollow opening 13 is formed from the rear end surface of the piston rod 11 of the direct-acting type actuator 10 in the axial direction, and the front section of the oscillating shaft 31 of the oscillating type actuator section 30 is inserted inside this hollow opening 13.

Though the oscillating type actuator section 30 is a dual-acting cylinder, a rod cover and a cylinder tube thereof are integrally formed with the head cover 12 of the direct-acting type actuator section 10, and the oscillating shaft 31 passes through the head cover 12 and is inserted inside the hollow opening 13 of the piston rod 11 of the direct-acting type actuator section 10, as described before.

The oscillating type actuator section 30 uses a driving method by oscillation using helical splines.

First, a hollow opening 33 is formed from the rear end surface of a piston rod 32 in the axial direction and a screwing board 34 with female screws each having a helical spline formed therein is mounted to the rear end surface of the piston rod 32 so that screw-formed sections correspond to the hollow opening 33.

On the other hand, a screwing rod 35 with male screws each having a helical spline corresponding to the helical spline of each of the female screws of the screwing board 34 formed therein is set up and secured to a position corresponding to the axis of a head cover 36. The external screws of the screwing rod 35 are meshed with the internal screws of the screwing board 34.

Accordingly, when the piston rod 32 advances or retracts, the piston rod 32 is rotated due to the meshing relationship described before. The oscillating shaft 31, which is coaxially integral with the piston rod 32 is therefore rotated.

In this case, the volume of a portion in front of the screwing rod 35 inside the hollow opening 33 will be increased or reduced. However, when the screwing board 34 is meshed with the screwing rod 35 by the helical splines, a sufficient gap can be secured, and through this gap, a working fluid is distributed. Thus, movement of the piston rod 32 will not be interfered by the increase or reduction of the volume.

A lead angle θ of the screw with the helical spline described before is set within the range of 45 to 87 degrees. However, when ball screws are applied as in the prior art, it is also possible to set the lead angle θ to be 45 degrees or smaller.

With regard to the relationship between the oscillating shaft 31 of the oscillating type actuator section 30 and the piston rod 11 of the direct-acting type actuator section 10, the oscillating shaft 31 and the hollow opening 13 of the piston rod 11 form the constrained pair of a sliding pair alone: The oscillating shaft 31 only slides in the axial direction within the hollow opening 13 of the piston rod 11. Thus, though the rotational force of the oscillating shaft 31 is transferred to the piston rod 11, neither of the oscillating shaft 31 nor the piston rod 11 exerts force on a relative motion in the axial direction.

Specifically, referring to FIG. 1(B) as well, a groove 31*a* is formed in the outer peripheral surface of the oscillating shaft 31 in the axial direction, and a key groove 11*a* is formed in the rear end section of the hollow opening 13 of the piston rod 11 of the direct-acting type actuator section 10. With a sliding key 14 loaded between the groove 31*a* and the key groove 11*a*, a snap ring 15 is mounted on the rear end surface of the piston rod 11 to prevent the sliding key 14 from coming off backward from the piston rod.

Accordingly, the oscillating shaft 31 is engaged with the piston rod 11 through the sliding key 14 in their rotating direction, and in regard to a mutual, relative movement in the axial direction, the sliding key 14 moves within the groove 31*a* alone, thereby forming the constrained pair of the sliding pair alone.

When the oscillating shaft 31 and the piston rod 11 move relatively, the volume of a portion in front of the oscillating shaft 31 within the hollow opening 13 will be increased or reduced. However, as shown in FIG. 1(B), a gap is formed between the inner peripheral surface of the hollow opening 13 and the outer peripheral surface of the oscillating shaft 31. Then, a working fluid is distributed through the gap, so that the relative movement of the oscillating shaft 31 and the piston rod 11 will not be interfered by the increase or reduction of the volume.

Next, as shown in FIG. 1(A), a sequence valve with check valve 40 and a stop valve 50 are added to the composite operation type actuator in this embodiment. In FIG. 1(A), the actual shapes of the valves are indicated by a chain double-dashed line, and within the actual shapes indicated by the chain double-dashed line, the valves are represented by symbols. The same representation of the valves will also be performed in FIGS. 3 to 11, and FIGS. 13 to 17.

The relationship between a passage constituted from a cylinder tube or the like and each of the valves 40 and 50 and arrangement of distribution ports will be described.

The sequence valve with check valve 40 is mounted on the direct-acting type actuator section 10. A cylinder chamber 17 on the side of a rod cover 16 of the direct-acting type actuator section 10 is connected to a cylinder chamber 37 on the side of the rod cover of the oscillating type actuator section 30 corresponding to the head cover 12 of the direct-acting type actuator section 10 through the sequence valve with check valve 40, and one distribution port 61 is provided for the passage connecting the cylinder chamber 37 and the sequence valve with check valve 40.

The portion of the sequence valve with check valve 40 connected to the cylinder chamber 37 forms a primary side.

The stop valve 50 is mounted on the oscillating type actuator section 30. A cylinder chamber 18 on the side of the head cover 12 of the direct-acting type actuator section 10 is connected to a cylinder chamber 38 on the side of the head cover 36 of the oscillating type actuator section 30 through the stop valve 50. Then, for the passage connecting the cylinder chamber 18 to the stop valve 50, other distribution port 62 is provided.

Then, to the distribution ports 61 and 62, a pump circuit and a drain circuit are connected through a four-port two-position switching valve 70.

Incidentally, though the above description is not given to the sections required for sealing such as the outer periphery of the piston and regions between cylinder components, a sealing member is applied to those sections as necessary.

Based on the above-mentioned configuration, the composite operation type actuator in this embodiment can enter three operating modes constituted from operating modes A1, B1, and C1 as shown in FIG. 2 according to the setting states of the sequence valve 40 with check valve and the stop valve 50.

Herein, a case where the composite operation type actuator is used for extracting the core pin for the die-casting mold is assumed. It is assumed that the straight-ahead driving force of the piston rod 11 of the direct-acting type actuator section 10 based on the supply pressure of the working fluid is sufficiently larger than the maximum extracting force of the core pin and that the rotational torque of the oscillating shaft 31 of the oscillating type actuator section 30 (which is also the rotational torque of the piston rod 11) is also sufficiently larger than the maximum torque required for rotating the core pin.

<A1 Mode>

When the sequence valve with check valve 40 is set to be open and the stop valve 50 is set to be closed, the actuator enters this operating mode.

The opening state of the sequence valve with check valve 40 is brought about in a case in which the set value of the pilot pressure at the time of switching of the sequence valve with check valve 40 from a closed state to an open state is set to zero or an extremely small value. In this case, the working fluid flows freely from the primary side to a secondary side, and the working fluid also flows freely in the opposite direction as well through the check valve. Thus, the sequence valve with check valve is open for bidirectional flows of the working fluid.

Then, in this case, the stop valve 50 is set to be closed. Thus, the oscillating type actuator section 30 is never actuated, and only the direct-acting type actuator section 10 operates as the ordinary dual-acting cylinder.

More specifically, as shown in FIG. 3, when the pump circuit is connected to the distribution port 62 for supply of the working fluid and the distribution port 61 is connected to the drain circuit through the four-port two-position switching valve 70, the working fluid flows into the cylinder chamber 18 to cause the piston rod 11 to move forward, so that the working fluid in the cylinder chamber 17 is drained to the drain circuit from the sequence valve with check valve 40 through the distribution port 61.

Figure 4:
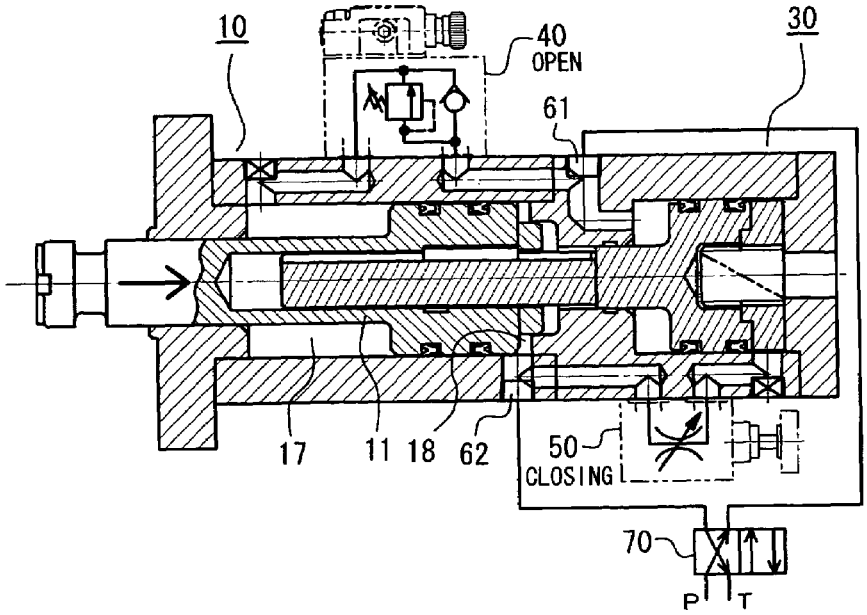
FIG. 4 is a diagram showing a section of the composite operation type actuator in the course of an operation in the A1 mode and a configuration of the attached fluid circuit, in the first embodiment.

On the contrary, as shown in FIG. 4, when the pump circuit is connected to the distribution port 61 for supply of the working fluid and the distribution port 62 is connected to the drain circuit, the working fluid flows into the cylinder chamber 17 through the sequence valve with check valve 40. The piston rod 11 is thereby retracted, so that the working fluid in the cylinder chamber 18 is drained to the drain circuit through the distribution port 62.

<B1 Mode>

When the sequence valve with check valve 40 and the stop valve 50 are both set to be open, the actuator enters this operating mode.

Figure 5:
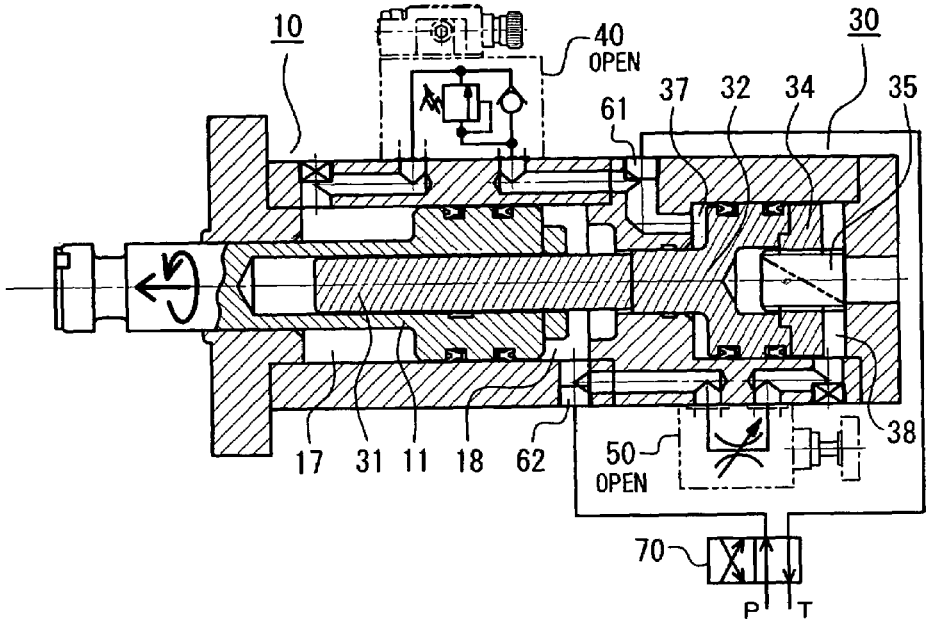
FIG. 5 is a diagram showing a section of the composite operation type actuator in the course of an operation in a B1 mode and the configuration of the attached fluid circuit, in the first embodiment.

In this mode, as shown in FIG. 5, when the pump circuit is connected to the distribution port 62 for supply of the working fluid and the distribution port 61 is connected to the drain circuit through the four-port two-position switching valve 70, the working fluid flows into the cylinder chamber 18 to cause the piston rod 11 to move forward. The working fluid also flows into the cylinder chamber 38 through the stop valve 50 in the open state to cause the screwing board 34 and the piston rod 32 to move forward.

The working fluid in the cylinder chamber 17 is drained to the drain circuit from the sequence valve with check valve 40 through the distribution port 61, and the working fluid in the cylinder chamber 37 is also drained to the drain circuit through the distribution port 61.

This advancement step of the piston rod 11 corresponds to the stage in which a core is set, and in this step, advancement of the piston rod 11 and advancement of the piston rod 32, which is integral with the screwing board 34, are performed in parallel. Due to the meshing relationship between the screwing rod 35 and the screwing board 34 for the piston rod 32, the piston rod 32 is rotated, and its rotational force is transferred from the oscillating shaft 31 to the piston rod 11 via the sliding key 14. Thus, the piston rod 11 will then move forward while rotating.

Figure 6:
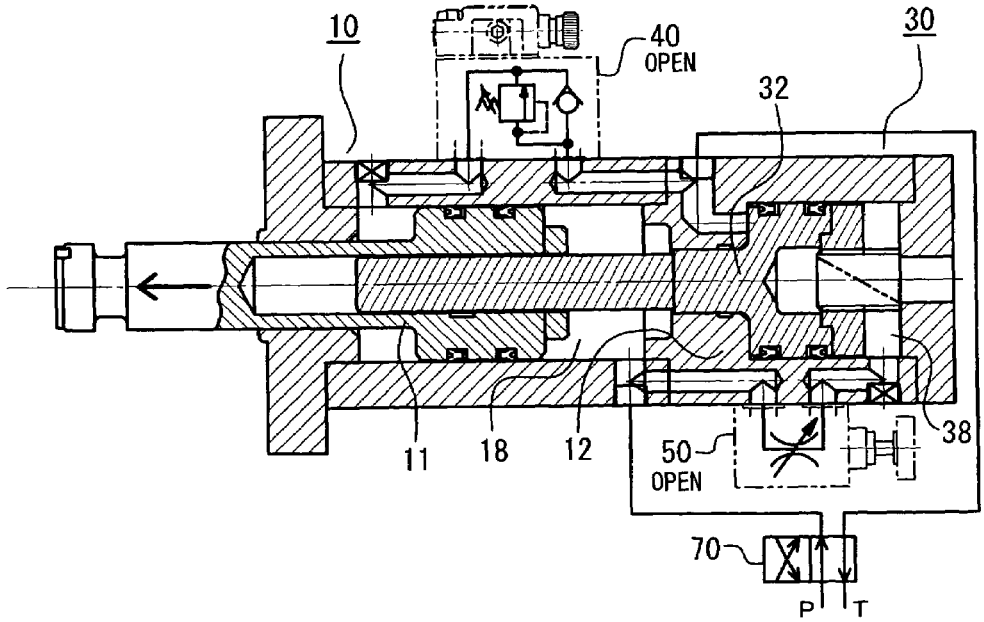
FIG. 6 is a diagram showing a section of the composite operation type actuator in the course of an operation in the B1 mode and the configuration of the attached fluid circuit, in the first embodiment.

When the above-mentioned motion is continued, the piston of the piston rod 32 becomes the state of a forward limit in which the piston of the piston rod 32 comes in contact with the rod cover or the head cover 12 of the direct-acting type actuator section 10, as shown in FIG. 6. Then, supply of the working fluid to the cylinder chamber 38 is stopped, so that the working fluid is supplied to the cylinder chamber 18 alone.

Accordingly, rotation of the piston rod 11 is stopped, and only the advancing motion of the piston rod 11 is continued.

Figure 7:
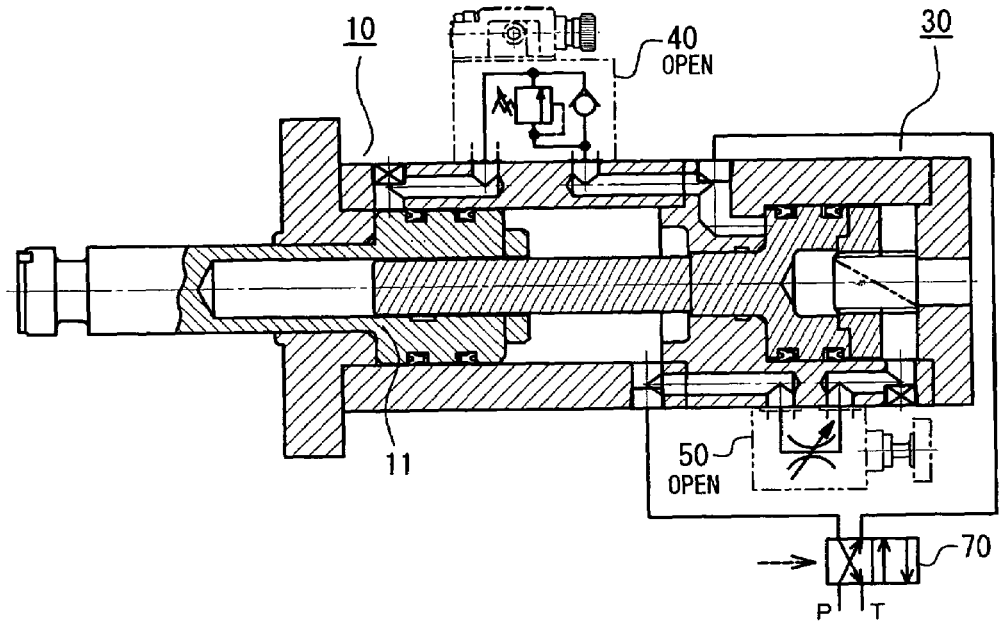
FIG. 7 is a diagram showing a section of the composite operation type actuator in the course of an operation in the B1 mode and the configuration of the attached fluid circuit, in the first embodiment.

Then, if advancement of the piston rod 11 is further continued, the piston rod 11 becomes the state of protrusion to its forward limit, as shown in FIG. 7. In this stage, the core has been set.

If a closed center four-port three-position switching valve is employed in place of the four-port two-position switching valve 70 and if the closed center four-port three-position switching valve is switched to be closed in the center in the course of the advancement step, the piston rod 11 can be stopped short of the forward limit at an arbitrary position.

After the core has been set, a series of die-casting steps are performed for a die-casting mold, and then when the core is to be extracted, the four-port two-position switching valve 70 is switched, as shown in FIG. 7.

Figure 8:
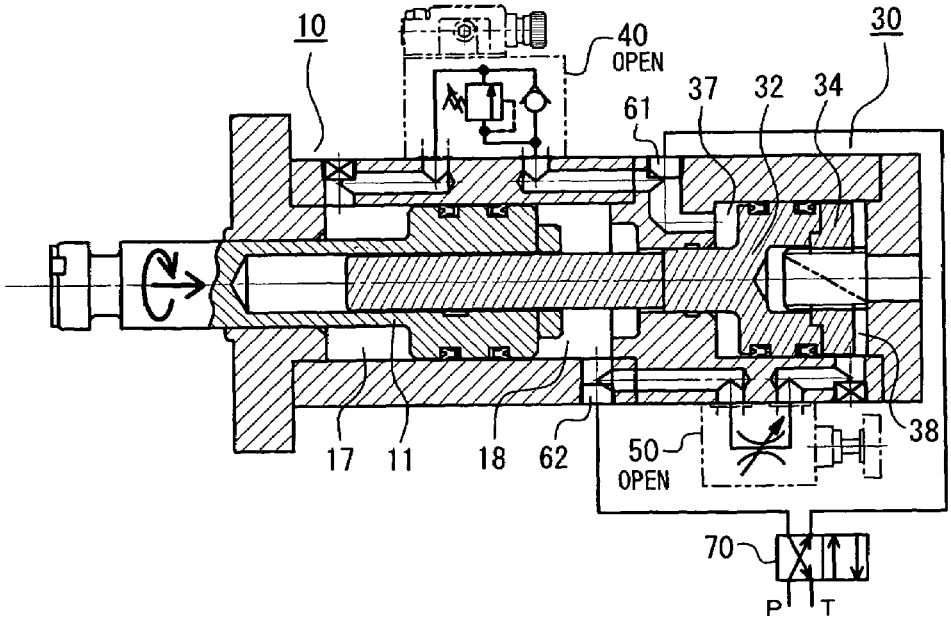
FIG. 8 is a diagram showing a section of the composite operation type actuator in the course of an operation in the B1 mode and the configuration of the attached fluid circuit, in the first embodiment.

FIG. 8 shows the state after the switching of the four-port two-position switching valve 70: When the distribution port 61 is connected to the pump circuit for supply of the working fluid and the distribution port 62 is connected to the drain circuit through the four-port two-position switching valve 70, the working fluid flows into the cylinder chamber 17 through the sequence valve with check valve 40 in the open state to cause the piston rod 11 to move backward. The working fluid also flows into the cylinder chamber 37 through the distribution port 61 to cause the piston rod 32 and the screwing board 34 to move backward.

The working fluid in the cylinder chamber 18 is drained to the drain circuit through the distribution port 62, and the working fluid in the cylinder chamber 38 is drained from the stop valve 50 in the open state to the drain circuit through the distribution port 62.

The retraction step of this piston rod 11 corresponds to the extraction stage of the core, and a certain load in the axial direction and a certain torque load are applied to the piston rod 11. Since the straight-ahead driving force of the piston rod 11 of the direct-acting type actuator section 10 and the rotational torque of the oscillating shaft of the oscillating type actuator section 30 are designed to be sufficiently larger than these loads as described above, retraction of the piston rod 11 and retraction of the piston rod 32 (that is integral with the screwing board 34) are performed in parallel.

Accordingly, the piston rod 32 is rotated in the direction opposite to that in the case of the advancement process, and this rotational force is transferred from the oscillating shaft 31 to the piston rod 11 via the sliding key 14. Thus, the piston rod 11 will then move backward while rotating.

It means that even if hot metal is solidified or semi-solidified, the core can be extracted while being rotated. Further, if the working condition of this core is utilized and a male screw with a helical spline is provided for the core pin in advance, formation of a female screw with a helical spline on a product also becomes possible.

Figure 9:
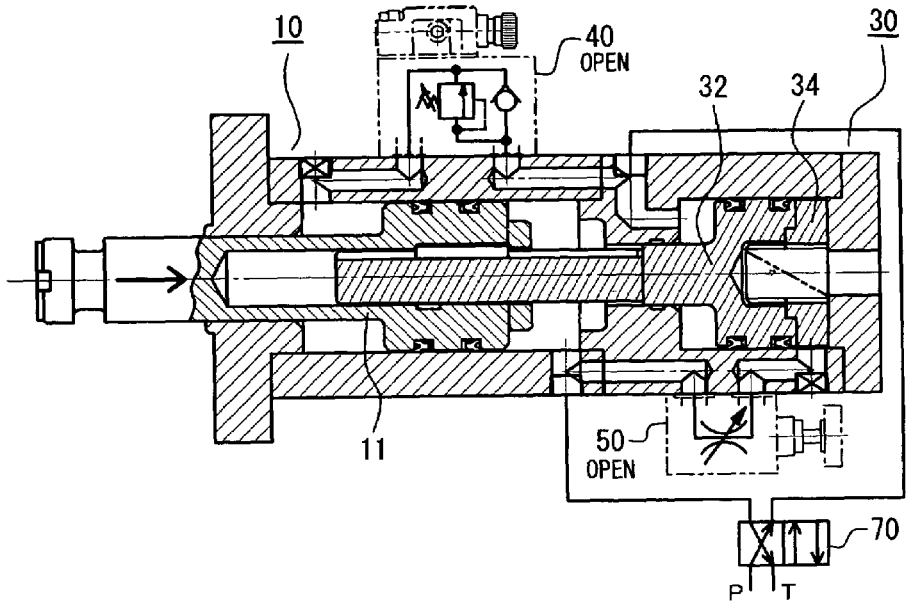
FIG. 9 is a diagram showing a section of the composite operation type actuator in the course of an operation in the B1 mode and the configuration of the attached fluid circuit, in the first embodiment.

Then, when retraction of the piston rod 11 and retraction of the piston rod 32 shown in FIG. 8 are further continued, the screwing board 34 is first brought into contact with the head cover 36, so that the piston rod 32 reaches its backward limit as shown in FIG. 9.

Accordingly, the piston rod 11 thereafter moves backward without rotating and reaches its backward limit, and thereby returns to the initial state shown in FIG. 1.

<C1 Mode>

When a pilot pressure set value at the time of switching of the sequence valve with check valve 40 from the closed state to the open state is set to a certain level and the stop valve 50 is set to be open, the actuator enters this operating mode.

In this case, when the distribution port 62 is connected to the pump circuit for supply of the working fluid and the distribution port 61 is connected to the drain circuit through the four-port two-position switching valve 70 as shown in FIGS. 5 and 6 indicating the B1 mode, the sequence valve with check valve 40 causes the working fluid discharged from the cylinder chamber 17 through advancement of the piston rod 11 to be distributed to the distribution port 61 through the check valve.

Further, since the stop valve 50 is in the open state, the operating conditions of the direct-acting type actuator section 10 and the oscillating type actuator section 30 when the four-port two-position switching valve 70 is set as described above are the same as in the B1 mode.

Accordingly, the piston rod 11 will move forward while rotating for an initial certain period alone, and will only move forward without rotating for the remaining period.

After the piston rod 11 has reached its forward limit, the four-port two-position switching valve 70 is switched as shown in FIG. 7, thereby connecting the distribution port 61 to the pump circuit for supply of the working fluid, and connecting the distribution port 62 to the drain circuit. Then, the actuator performs the following operation.

First, in the oscillating type actuator section 30, as in the stage in the B1 mode shown in FIG. 8, the piston rod 32 is retracted and rotated in the direction opposite to that in the case of the advancement step, and its rotational force is transferred to the piston rod 11 from the oscillating shaft 31 via the sliding key 14. The piston rod 11 will be thereby rotated.

However, in the direct-acting type actuator section 10, even if the working fluid is supplied to the primary side of the sequence valve with check valve 40 through the distribution port 61, the sequence valve with check valve 40 remains closed if the pilot pressure does not become the set value or higher, so that the piston rod 11 maintains its position without being retracted.

Figure 10:
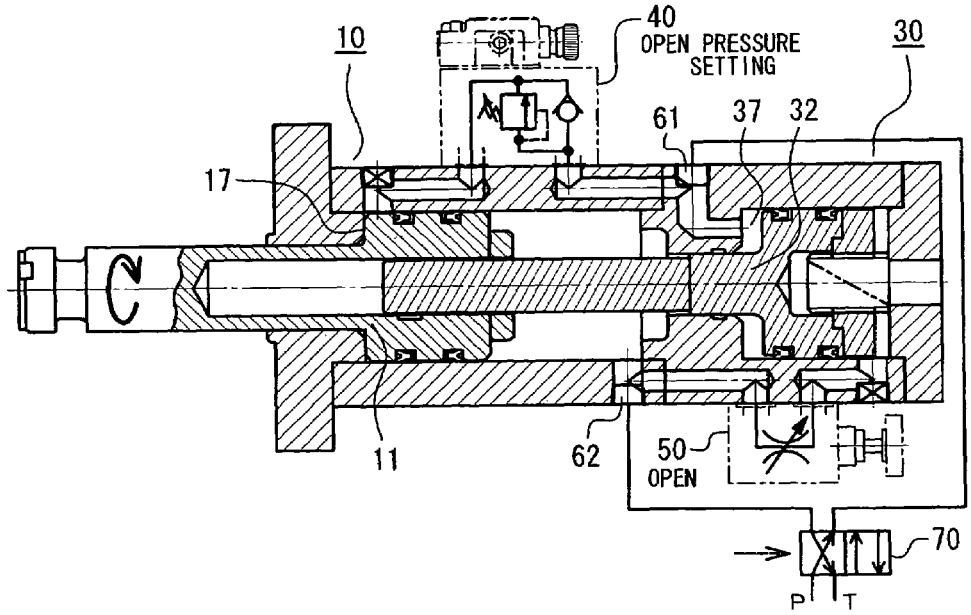
FIG. 10 is a diagram showing a section of the composite operation type actuator in the course of an operation in a C1 mode and the configuration of the attached fluid circuit, in the first embodiment.

Accordingly, as shown in FIG. 10, the piston rod 11 only rotates at the position of the forward limit, and the piston rod 32 retracts while applying its rotational torque.

Then, when the piston rod 32 has reached its backward limit, no working fluid flows into the cylinder 37. Thus, the pressure on the primary side of the sequence valve with check valve 40 is increased. When its fluid pressure becomes the set pilot pressure or higher, the sequence valve with check valve 40 is switched from the closed state to the open state, so that the working fluid flows into the cylinder chamber 17 through the sequence valve with check valve 40. The piston rod 11 thereby begins to move backward.

As clear from comparison using FIG. 2, in the B1 mode, the piston rod 11 is retracted while being turned. In the C1 mode, on the other hand, the piston rod 11 is only rotated initially, and then retracted.

When extracting the core, depending on the type, temperature condition, or the like of the hot metal, it often happens that only rotating the piston rod 11 initially as in the C1 mode is more effective for the extraction of the core.

Second Embodiment

Figures 11, 12:
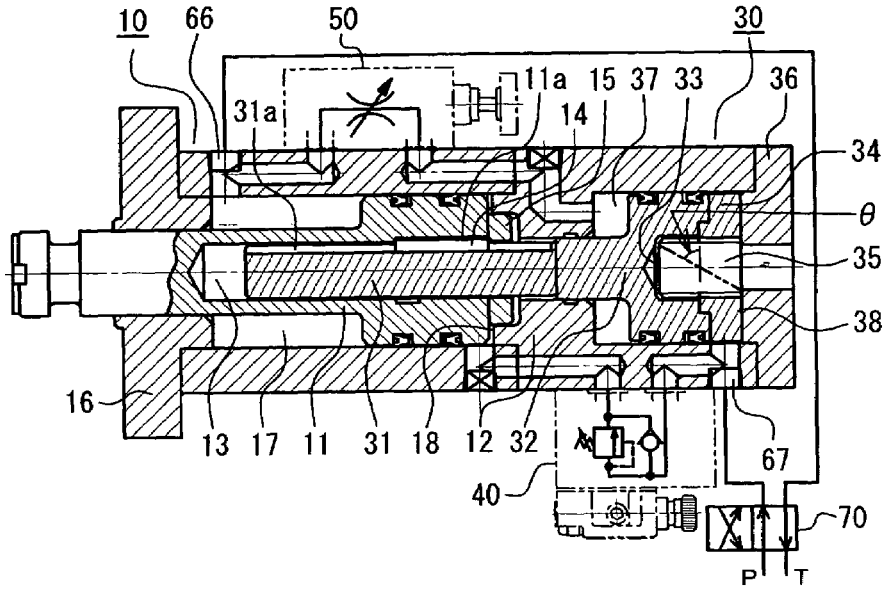
FIG. 11 is a diagram showing a section of a composite operation type actuator and a configuration of an attached fluid circuit according to a second embodiment of the present invention.
FIG. 12 is an operating mode table showing the relationship between setting conditions of a sequence valve with check valve and a stop valve and a motion of a piston rod in the composite operation type actuator in the second embodiment.

A sectional view of a composite operation-type actuator and a configuration of an attached fluid circuit according to a second embodiment of the present invention are shown in FIG. 11.

First, as clear from comparison between FIG. 11 and FIG. 1, mechanisms of the direct-acting type actuator section 10 and the oscillating type actuator section 30 are identical to those of the composite operation type actuator in the first embodiment. Thus, a description about these actuator sections 10 and 30 will be omitted.

The composite operation actuator in this embodiment is different from the composite operation actuator in the first embodiment in that mounting positions of the sequence valve with check valve 40 and the stop valve 50 are reversed, and that the positions of the two distribution ports 66 and 67 are different.

The cylinder chamber 17 on the side of the rod cover 16 of the direct-acting type actuator section 10 is connected to the cylinder chamber 37 on the side of the rod cover of the oscillating type actuator section 30 through the stop valve 50. The rod cover of the oscillating type actuator section 30 corresponds to the head cover 12 of the direct-acting type actuator section 10. To the connecting passage between the cylinder chamber 17 and the stop valve 50, the distribution port 66, which is one of the two ports used in this embodiment, is connected.

The cylinder chamber 18 on the side of the head cover of the direct-acting type actuator section 10 is connected to the cylinder chamber 38 on the side of the head cover 36 of the oscillating type actuator section 30 through the sequence valve with check valve 40. To the connecting passage between the cylinder chamber 38 and the sequence valve with check valve 40, the distribution port 67, which is the other of the two distribution ports used in this embodiment, is connected.

The portion of the sequence valve with check valve 40 connected to the cylinder chamber 38 becomes the primary side.

Then, the composite operation type actuator in this embodiment as well can enter three operating modes (A2, B2, and C2) as shown in FIG. 12 according to the setting states of the sequence valve with check valve 40 and the stop valve 50.

In the A2 mode among these operating modes, the sequence valve with check valve 40 is set to be open, while the stop valve 50 is set to be closed. Thus, a fluid circuit is configured for which the direct-acting type actuator section 10 can be used as the ordinary double-acting cylinder with the oscillating type actuator section 30 not functioning. Thus, the A2 mode is the same as the A1 mode in the first embodiment.

Further, in the B2 mode, the sequence valve with check valve 40 and the stop valve 50 are both set to be open. Thus, even if the positions of the distribution ports 66 and 67 are different from those in FIG. 1, the configuration of the fluid circuit becomes identical to that in the B1 mode in the first embodiment. Accordingly, as described before about the B1 mode, the piston rod 11 can be operated in the order of advancement with rotation, advancement, retraction with rotation, and retraction.

The motion of the piston rod 11 in this embodiment which is different from that in the first embodiment is in the case of the C2 mode alone: In this mode, the set value of the pilot pressure when the sequence valve with check valve 40 is switched from the closed state to the open state is set to a certain level, and the stop valve is set to be open.

In terms of the motions of the piston rod 11, in the C1 mode in the first embodiment, the piston rod 11 starts from its initial state of the backward limit and returns to the initial state, after performing the motions of advancement with rotation, advancement, rotation, and retraction with rotation in this stated order. In the initial state of the piston rod 11, the piston rod 32 is also in the state of the backward limit. On contrast therewith, in the C2 mode in this embodiment, the piston rod 11 starts from the initial state and returns to the initial state, after performing the motions of rotation, advancement, retraction with rotation, and retraction in this stated order. The motions of the piston rod 11 in the C2 mode differs from the motions of the piston rod 11 in the C1 mode only in that the step of performing the rotating motion alone is executed from the forward limit or the backward limit (initial state).

When the distribution port 67 is connected to the pump circuit to supply the working fluid and the distribution port 66 is connected to the drain circuit through the four-port two-position switching valve 70 with the piston rods 11 and 32 being in the backward limit, as shown in FIG. 11, the working fluid flows into the cylinder chamber 38 to cause the piston rod 32 (that is integral with the screwing board 34) to move forward. Then, based on the meshing relationship between the screwing board 34 and the screwing rod 35, the piston rod 32 rotates, so that the oscillating shaft 31 rotates. The piston rod 11 thereby rotates. Incidentally, the working fluid in the cylinder chamber 37 is drained to the drain circuit from the stop valve 50 in the open state through the distribution port 66.

On the other hand, though the distribution port 67 is linked to the primary side of the sequence valve with check valve 40, the sequence valve with check valve 40 remains closed unless the pilot pressure of the sequence valve with check valve 40 becomes the set value or higher. In this stage, the working fluid will not flow to the cylinder chamber 18. Thus, the piston rod 11 will not move in the axial direction.

Figure 13:
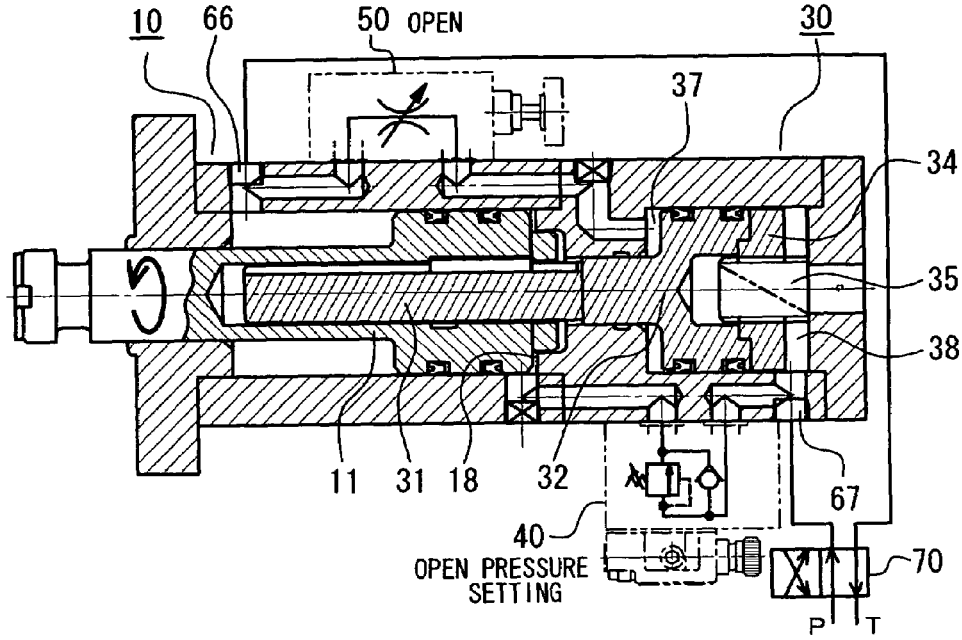
FIG. 13 is a diagram showing a section of the composite operation type actuator in the course of an operation in a C2 mode and the configuration of the attached fluid circuit, in the second embodiment.

Accordingly, as shown in FIG. 13, the piston rod 11 only rotates, and its rotation continues until the piston rod 32 reaches the forward limit.

Figure 14:
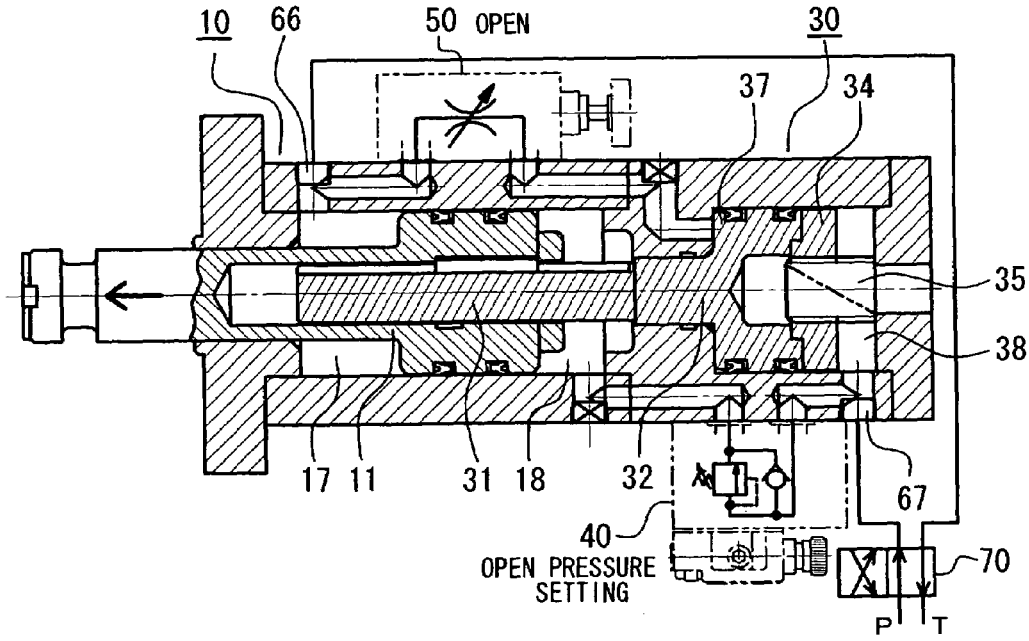
FIG. 14 is a diagram showing a section of the composite operation type actuator in the course of an operation in the C2 mode and the configuration of the attached fluid circuit, in the second embodiment.

Next, when the piston rod 32 reaches the forward limit as shown in FIG. 14, flow of the working fluid into the cylinder 38 is stopped, the pressure on the primary side of the sequence valve with check valve 40 is increased. When the pressure of the fluid on the primary side becomes the set pilot pressure or higher, the sequence valve with check valve 40 is switched from the closed state to the open state.

Accordingly, the working fluid flows into the cylinder chamber 18 through the sequence valve with check valve 40, and in this stage, the piston rod 11 starts to move forward.

It means that in the C2 mode, when actuated from the backward limit (or the initial state), the piston rod 11 performs the advancing motion after performing the rotating motion.

Figure 15:
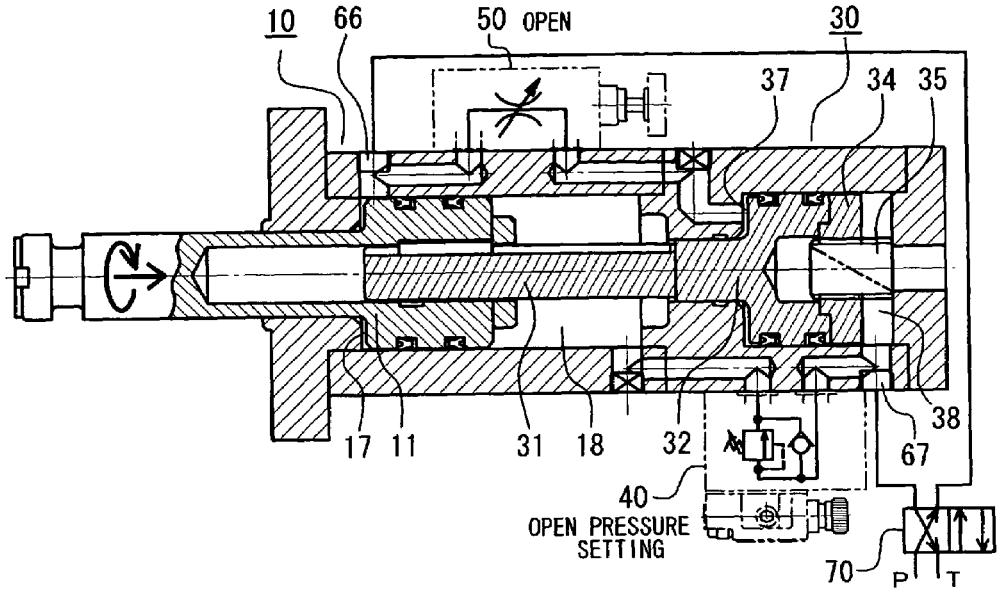
FIG. 15 is a diagram showing a section of the composite operation type actuator in the course of an operation in the C2 mode and a configuration of the attached fluid circuit, in the second embodiment.

On the other hand, when the piston rod 11 and the piston rod 32 are in their forward limits as shown in FIG. 15, and when the pump circuit is connected to the distribution port 66 for supply of the working fluid and the distribution port 67 is connected to the drain circuit through the four-port two-position switching valve 70, the working fluid supplied to the distribution port 66 directly flows into the cylinder 17 and also flows into the cylinder chamber 37 through the stop valve 50 in the open state, so that the piston rods 11 and 37 are retracted. In this case, the working fluid in the cylinder chamber 18 is drained to the drain circuit from the check valve of the sequence valve with check valve 40 through the distribution port 67, and the working fluid in the cylinder chamber 38 is directly drained to the drain circuit through the distribution port 67.

Accordingly, as in the B1 mode in the first embodiment and the B2 mode in this embodiment, the piston rod 11 will retract while rotating.

Generally, the motion of the piston rod 11 described above is not needed for extraction of the core pin. However, this motion is sometimes needed for the operation of an arm or the like of working robots. Thus, this motion may be used for such applications.

Third Embodiment

Figure 17:
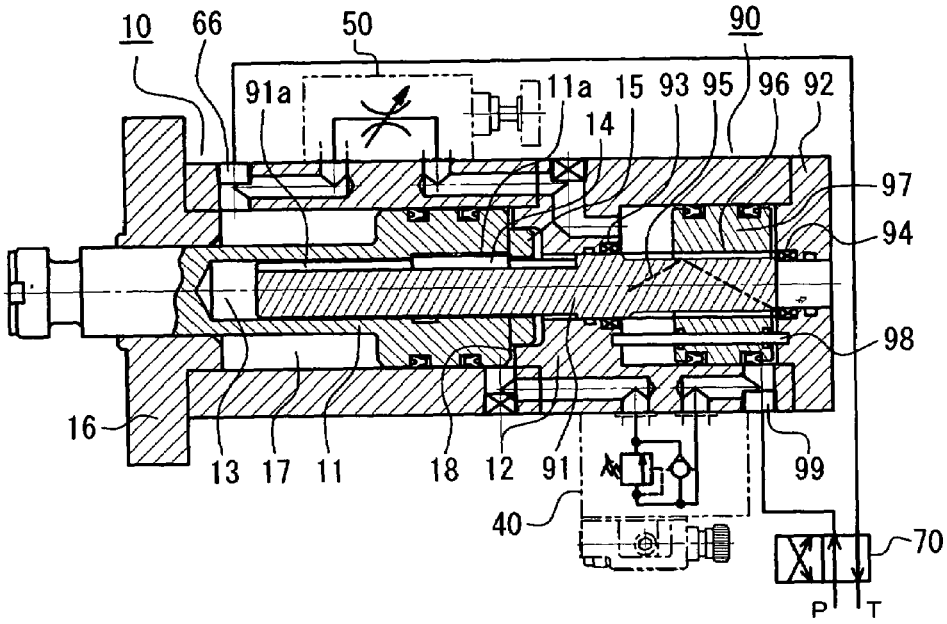
FIG. 17 is a diagram showing a section of the other of the composite operation type actuators and a configuration of an attached fluid circuit in the third embodiment.
Figure 18:
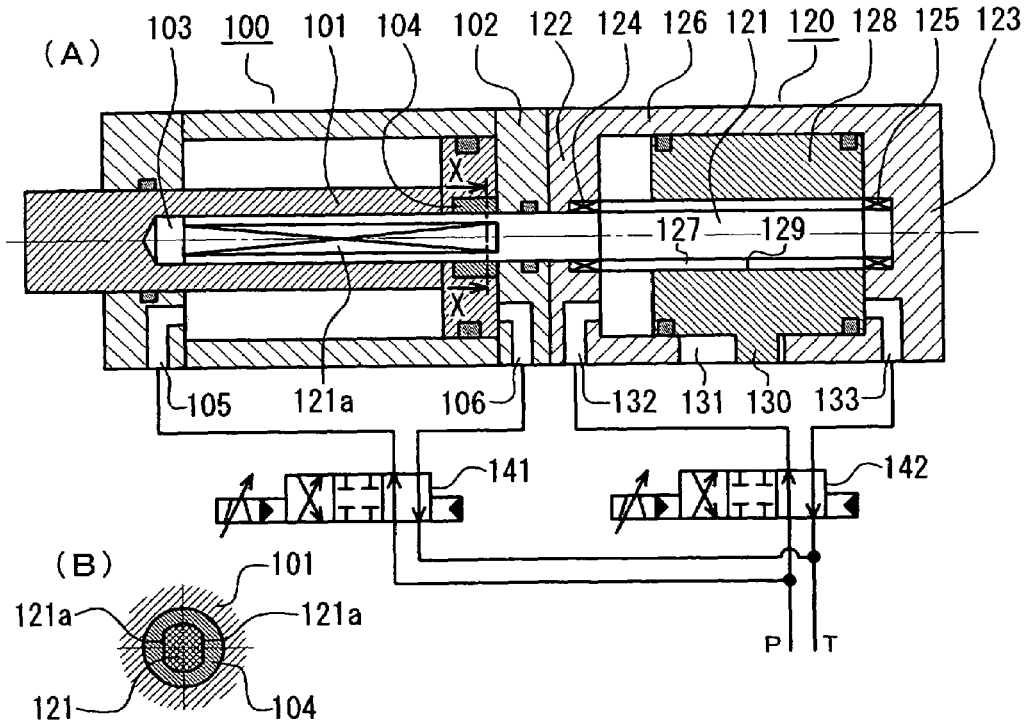
Fig.18 ( Prior Art )
FIG. 18 is a diagram showing a section of a composite operation type actuator and a configuration of an attached fluid circuit according to a prior art (disclosed in Japanese Utility Model Unexamined Publication HEI02-14803)

In the composite operation type actuator in this embodiment, the driving system used in the prior art shown in FIG. 18 is applied to the oscillating type actuator section in the first and second embodiments. A sectional view of the composite operation type actuator and a configuration of an attached fluid circuit in this embodiment are shown in each of FIGS. 16 and 17.

Figure 16:
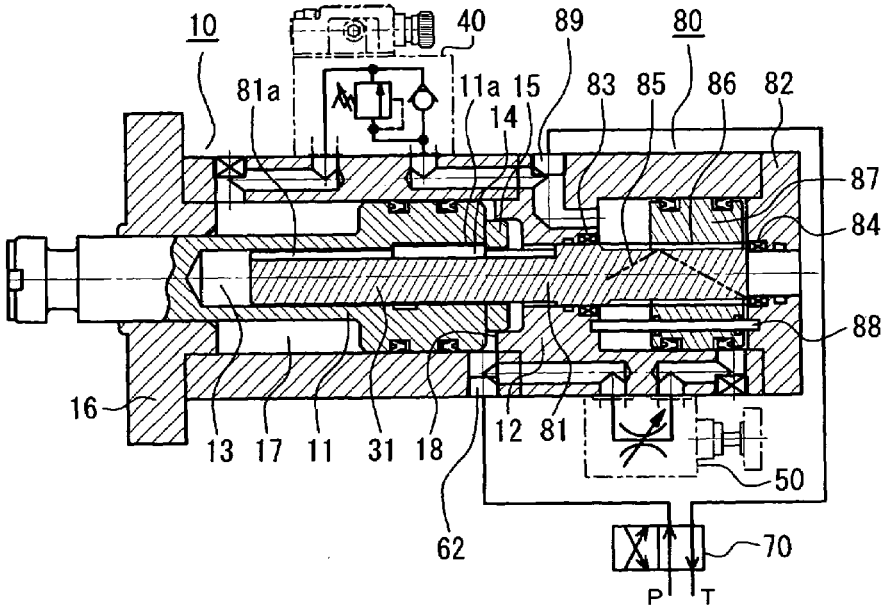
FIG. 16 is a diagram showing a section of one of composite operation type actuators and a configuration of an attached fluid circuit according to a third embodiment of the present invention.

Referring to FIGS. 16 and 17, the direct-acting type actuator section 10, sequence valve with check valve 40, and stop valve 50 have the same structures as those in the first and second embodiments, and respective components indicated by the same reference characters are the same as those in FIGS. 1 and 11.

Oscillating type actuator sections 80 and 90 have a cylinder structure, and oscillating shafts 81 and 91 are rotatably supported by the head cover 12 on the side of the direct-acting type actuator section 10. Further, the oscillating shafts 81 and 91 are rotatably supported by radial bearings 83 and 84 mounted on a rear end cover 80, and radial bearings 93 and 94 mounted on a rear end cover 92, respectively.

Then, male screws 85 and 95 each having a helical spline are formed in the oscillating shafts 81 and 91 in the segments of the oscillating type actuator sections 80 and 90, respectively. Then, a piston 87 with a female screw 86 having a corresponding helical spline formed therein to be screwed into the male screw 85, and a piston 97 with a female screw 96 having a corresponding helical spline formed therein to be screwed into the male screw 95 are furnished.

The lead angles of the male screws 85 and 95 and the lead angles of the female screws 86 and 96 are set in the range of 45° to 87°. However, when the ball screws are used as in the prior art, the lead angles can be set to be further smaller.

Further, through holes in the axial direction are formed in the pistons 87 and 97 in the positions shifted from the openings of the female screws 86 and 96, respectively, and rods 88 and 98 placed laterally and fixed between the head cover 12 and the rear end cover 82 and between the head cover 12 and the rear end cover 92, respectively, are inserted through the through holes. The rotation stop mechanisms of the pistons 87 and 97 are thereby configured.

The front sections of the oscillation shafts 81 and 91 are inserted into the hollow opening 13 of the piston rod 11 on the side of the direct-acting type actuator section 10 as in the oscillating shaft 31 in the first and second embodiments, and form the constrained pair of a sliding pair alone with the hollow opening 13 in the axial direction.

Grooves 81*a* and 91*a* in the axial direction are formed in the outer peripheral surfaces of the oscillation shafts 81 and 91, respectively, and a sliding key 14 is loaded between a key groove 11*a* formed in the rear end section of the hollow opening 13 of the piston rod 11 and the grooves 81*a* and 91*a*, respectively.

Though the rotational force of the oscillating shaft 31 is transferred to the piston rod 11, the piston rod 11 can move freely in the axial direction.

Accordingly, due to the distribution control of the working fluid through a distribution port 89 and the distribution port 62, the oscillating shaft 81 can be rotated in the oscillating type actuator section 80 as in the first and second embodiments. Further, due to the distribution control of the working fluid through the distribution port 66 and a distribution port 99, the oscillating shaft 91 can be rotated in the oscillating actuator section 90, as in the first and second embodiments. Thus, the motions of the piston rod 11 in the tables shown in FIGS. 2 and 12 can be implemented by the composite operation type actuators in FIGS. 16 and 17 as well, based on the setting conditions of the respective valves 40 and 50.

What is claimed is:

1. A composite operation type actuator comprising a direct-acting type actuator section and an oscillating type actuator section of a cylinder structure, said oscillating type actuator section being coupled to a head cover of said direct-acting type actuator section so that a piston rod of said direct-acting type actuator section is disposed on a same axis as an oscillating shaft of said oscillating type actuator section, said oscillating shaft passes through said head cover and being fitted inside a hollow opening formed from a rear surface side of said piston rod of said direct-acting type actuator section in an axial direction of said composite operation type actuator, said oscillating shaft and said hollow opening being combined to form a constrained pair of a sliding pair alone in the axial direction, thereby enabling reciprocating and oscillating motions of said piston rod of said direct-acting type actuator section, wherein a cylinder chamber on a side of a rod cover of said direct-acting type actuator section is connected to one of two cylinder chambers of said oscillating type actuator section, hereinafter referred to as a "first cylinder chamber", through a sequence valve with check valve;

a cylinder chamber on a side of said head cover of said direct-acting type actuator section is connected to the other of said cylinder chambers of said oscillating type actuator section, hereinafter referred to as a "second cylinder chamber", through a stop valve or a throttle valve;

distribution ports are provided for a connecting passage between said first cylinder chamber of said oscillating type actuator section and said sequence valve with check valve and a connecting passage between said cylinder chamber on the side of said head cover of said direct-acting type actuator section and said stop valve or said throttle value, respectively; and each of the motions of said piston rod of said direct-acting type actuator section can be adjusted and set according to a setting condition of a pilot pressure of said sequence valve with check valve and an open-state or closed-state setting condition of said stop valve or said throttle valve.

2. A composite operation type actuator comprising a direct-acting type actuator section and an oscillating type actuator section of a cylinder structure, said oscillation type actuator section being coupled to a head cover of said direct-acting type actuator section so that a piston rod of said direct-acting type actuator section is disposed on a same axis as an oscillating shaft of said oscillating type actuator section, said oscillating shaft passing through said head cover and being fitted inside a hollow opening formed from a rear surface side of said piston rod of said direct-acting type actuator section in an axial direction of said composite operation type actuator, said oscillating shaft and said hollow opening being combined to form a constrained pair of a sliding pair alone in the axial direction, thereby enabling reciprocating and oscillating motions of said piston rod of said direct-acting type actuator section, wherein a cylinder chamber on a side of a rod cover of said direct-acting type actuator section is connected to a first cylinder chamber of said oscillating type actuator section through a stop valve or a throttle valve;

a cylinder chamber on a side of said head cover of said direct-acting type actuator section is connected to a second cylinder chamber of said oscillating type actuator section through a sequence valve with check valve;

distribution ports are provided for a connecting passage between said cylinder chamber on the side of said rod cover of said direct-acting type actuator section and said stop valve or said throttle valve and a connecting passage between said second chamber of said oscillating type actuator section and said sequence valve with check valve, respectively; and each of the motions of said piston rod of said direct-acting type actuator section can be adjusted and set according to a setting condition of a pilot pressure of said sequence valve with check valve and an open-state or closed-state setting condition of said stop valve or said throttle valve.

* * * * *